US010297368B2

(12) United States Patent
Chen et al.

(10) Patent No.: US 10,297,368 B2
(45) Date of Patent: May 21, 2019

(54) CABLE HAVING IMPROVED WIRES ARRANGEMENT

(71) Applicant: FOXCONN INTERCONNECT TECHNOLOGY LIMITED, Grand Cayman (KY)

(72) Inventors: Zu-Xuan Chen, Huaian (CN); Hong-Ping Wang, Huaian (CN); Lu-Yu Chang, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 267 days.

(21) Appl. No.: 15/215,859

(22) Filed: Jul. 21, 2016

(65) Prior Publication Data

US 2017/0025203 A1 Jan. 26, 2017

(30) Foreign Application Priority Data

Jul. 22, 2015 (CN) ..... 2015 2 0533889 U

(51) Int. Cl.
*H01B 11/20* (2006.01)

(52) U.S. Cl.
CPC ..... *H01B 11/20* (2013.01)

(58) Field of Classification Search
CPC ..... H01B 11/20
See application file for complete search history.

(56) References Cited

U.S. PATENT DOCUMENTS 4,719,319 A * 1/1988 Tighe, Jr. ..... H01B 7/0823 174/103
6,452,107 B1 * 9/2002 Kebabjian ..... H01B 11/002 174/113 R
6,534,716 B1 * 3/2003 Linnell ..... H01B 11/06 174/113 C
8,039,749 B2 * 10/2011 Okano ..... H01B 11/1008 174/113 R
8,076,580 B2 * 12/2011 Kolasa ..... H01B 11/00 174/105 R
2007/0212009 A1 * 9/2007 Lu ..... G02B 6/4472 385/135
2010/0051318 A1 * 3/2010 Wang ..... H01B 11/12 174/113 R
2010/0084157 A1 * 4/2010 Wang ..... H01B 11/12 174/107
2010/0258333 A1 * 10/2010 Horan ..... H01B 11/1091 174/78

(Continued)

OTHER PUBLICATIONS

Universal Serial Bus Type-C Cable and Connector Specification Revision 1.0 Aug. 11, 2014.

*Primary Examiner* — Timothy J Thompson
*Assistant Examiner* — Rhadames Alonzo Miller
(74) *Attorney, Agent, or Firm* — Wei Te Chung; Ming Chieh Chang

(57) ABSTRACT

A cable (100) includes: plural centrally disposed first wires (1); an inner shielding layer (17) enclosing the first wires; plural second wires (2) disposed at an outer side of the inner shielding layer for transmitting a common power signal; and plural pairs of differential signal wires (3) disposed at the outer side of the inner shielding layer; wherein each pair of differential signal wires is disposed between two adjacent second wires.

20 Claims, 3 Drawing Sheets

(56) References Cited

U.S. PATENT DOCUMENTS

| | | | | |
|---|---|---|---|---|
| 2011/0097931 | A1* | 4/2011 | Kondo | H01R 27/02 439/607.01 |
| 2011/0162866 | A1* | 7/2011 | Masakazu | H01B 11/002 174/103 |
| 2011/0278043 | A1* | 11/2011 | Ueda | H01B 7/1895 174/115 |
| 2012/0227996 | A1 | 9/2012 | Ardisana, II et al. | |
| 2013/0343713 | A1* | 12/2013 | Hayashishita | G02B 6/4434 385/103 |
| 2014/0000924 | A1* | 1/2014 | Horan | H01B 11/1091 174/32 |
| 2015/0137861 | A1* | 5/2015 | Cornelius | G01D 5/12 327/141 |
| 2015/0270028 | A1 | 9/2015 | Tsao et al. | |
| 2016/0020002 | A1* | 1/2016 | Feng | H01B 11/20 174/103 |
| 2016/0079689 | A1 | 3/2016 | Wu et al. | |
| 2016/0225488 | A1* | 8/2016 | Pon | H01B 9/003 |

* cited by examiner

CABLE HAVING IMPROVED WIRES ARRANGEMENT

BACKGROUND OF THE INVENTION

1. Field of the Invention

The present invention relates to a cable, and more particularly to a cable used for USB type C.

2. Description of Related Arts

U.S. Patent Application Publication No. 2016/0079689, published on Mar. 17, 2016 to Wu et al., discloses a cable comprising a plurality of coaxial wires and a plurality of single core wires. Each of the coaxial wires comprises a central conductor, an insulator enclosing the central conductor, a shielding layer enclosing the insulator, and a jacket enclosing the shielding layer. The structure of the coaxial wires entails an expensive manufacturing process. The coaxial wires are so arranged side by side along a circular direction that cross talk between adjacent coaxial wires may occur under a high speed signal transmission.

U.S. Patent Application Publication No. 2010/0258333, published on Oct. 14, 2010 to Horan et al., discloses a high speed data cable with shield connection. A cross-sectional view of a raw high speed Universal Serial Bus (USB) cable disclosed therein shows a concentric ring arrangement of signal and ground wires. According to an embodiment, nine insulating wires are arranged as follows: a pair of insulated data signal wires D0+ and D0−; a first pair of insulated super-speed data signal wires S0+ and S0−; a second pair of insulated super-speed data signal wires S1+ and S1−; and three insulated ground wires, or ground conductors G0, G1, and G2.

USB Type-C Cable and Connector Specification Revision 1.0 published on Aug. 11, 2014, illustrates a high speed cable comprising a plurality of first wires (for USB 2.0 signaling, SBU1, SBU2, CC, power return, and Vconn), an inner shielding layer enclosing the first wires, a plurality of coaxial wires (differential pairs) for high speed signaling arranged at an outer side of the inner shielding, and a power wire disposed between the coaxial wires.

SUMMARY OF THE INVENTION

An object of the present invention is to provide a cable having a simple structure, low cost, easy to manufacture, and improved high speed signal transmission performance.

To achieve the above-mentioned object, a cable comprises: a plurality of first wires centrally disposed; an inner shielding layer enclosing the first wires; a plurality of second wires disposed at an outer side of the inner shielding layer for transmitting a common power signal; and a plurality of pairs of differential signal wires disposed at the outer side of the inner shielding layer; wherein each pair of differential signal wires is disposed between two adjacent second wires.

DETAILED DESCRIPTION OF THE PREFERRED EMBODIMENT

Reference will now be made in detail to a preferred embodiment of the present invention.

Figure 1:
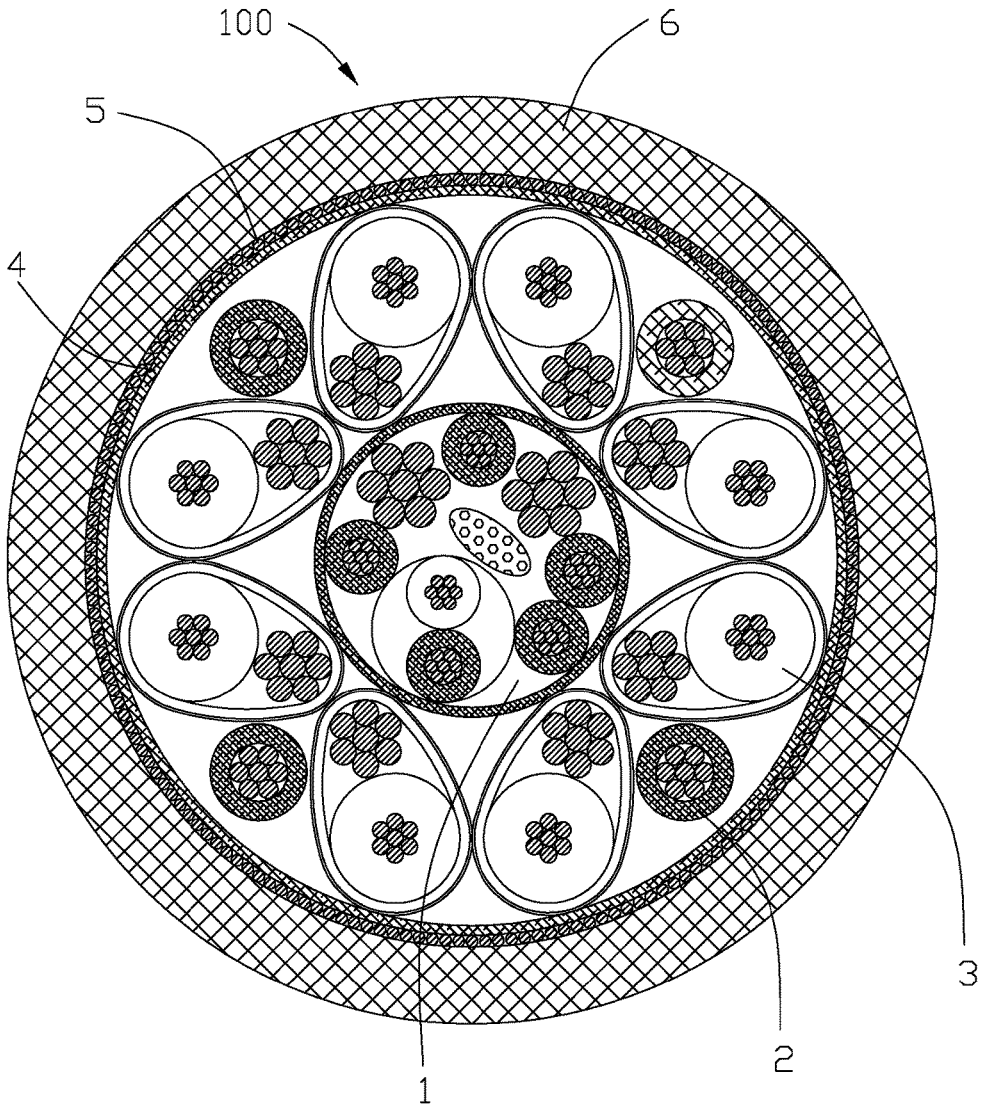
FIG. 1 is a cross section view of a cable in accordance with present invention.
Figure 2:
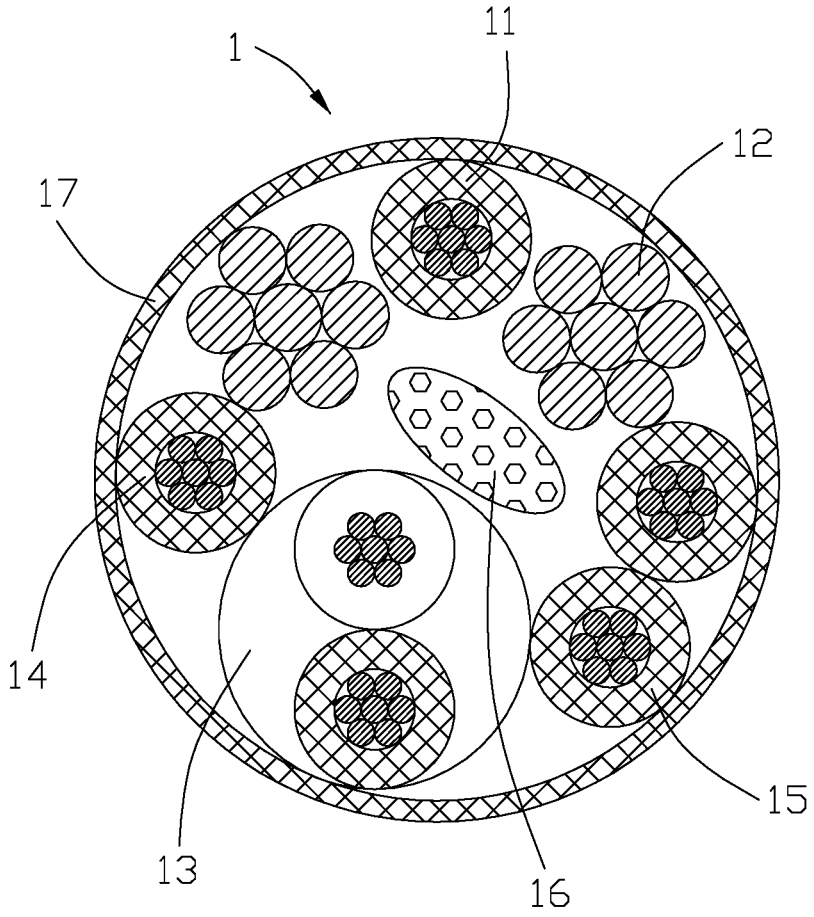
FIG. 2 is a cross section view of first wires of the cable as shown in FIG. 1.
Figure 3:
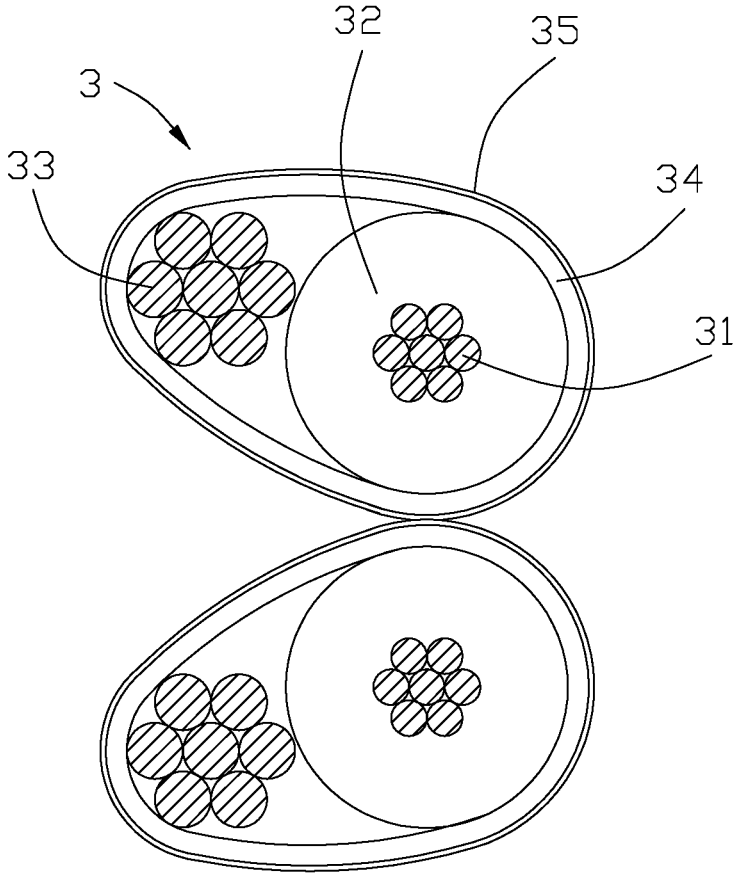
FIG. 3 is a cross section view of a pair of the differential wires of the cable as shown in FIG. 1.

Referring to FIGS. 1 to 3, a cable 100 comprises a plurality of first wires 1 disposed at a central portion of the cable 100, a plurality of second wires 2 for transmitting a common power signal, a plurality of differential signal wire pairs 3 for transmitting high speed signal, a tap layer 4 enclosing the differential signal wires pairs 3 and the second wires 2, an outer shielding layer 5 enclosing the tap layer 4, and a jacket 6 enclosing the outer shielding layer 5. The tap layer 4 is formed by aluminum foil or polythylene terephthalate. The tap layer 4 can provide EMI shielding when the cable 1 is used to transmitting high frequency signal.

The second wires 2 and the differential signal wires pairs 3 are arranged at an outer side of the first wires 1 and spaced apart with each other. In this embodiment, the number of the differential signal wires pairs 3 is four, and the number of the second wires 2 is four. But, the number of the differential signal wires pairs 3 and the second wires 2 may be in accordance with the needed.

The first wires 1 comprises a pair of twist wires for transmitting USB 2.0 signal 13, a detection signal wire 11, a pair of power grounding wires 12 disposed at opposites of the detection signal wire 11, a power wire 15 disposed at a side of the twist wires 13, a pair of spare wires 14 disposed between the power grounding wires 12 and the twist wires 13 and the power wire respectively. The cable 100 further comprises a filler disposed at a central of the first wires 1 to fill the gap of the first wires 1. The spare wires 14 may be used for transmitting audio or video signal. The cable 100 comprises an inner shielding layer 17 enclosing the first wires 1. The inner shielding layer 17 is formed by aluminum foil or polythylene terephthalate. The inner shielding layer 17 may reduce a cross talk between the second wires 2 and the first wires 1.

The second wires 2 and the differential signal wire pairs 3 are disposed between the inner shielding layer 17 and the tap layer 4. Each pair of the differential signal wires pairs 3 is disposed between two adjacent of the second wires 2, respectively. Each of the differential signal wire pairs 3 comprises a central conductor 31 for transmitting signal, an insulator 32 enclosing the central conductor 31, a drain wire 33 disposed at an outer side of the insulator 32, a shielding layer 34 enclosing the drain wire 33 and the insulator 32, and a tap 35 enclosing the shielding layer 34. The drain wire 33 contacts and electrically connects with the shielding layer 34. The drain wire 33 has a diameter less than a diameter of the insulator 32. Both of the central conductor 31 and the drain wire comprise a plurality of conductors. Geometrically, each of the two differential-pair signal wires e defines a tumbler configuration with a large bottom portion (not labeled) and a small top portion (not labeled) commonly surrounded within a shield layer 34 in the cross-section view, and the bottom portion includes a central conductor 31 enclosed within an inner insulator 32, and the top portion includes a drain wire 33 contacting the shield layer 34.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable comprising:

a plurality of first wires centrally disposed;

an inner shielding layer enclosing the first wires;

a plurality of second wires disposed at an outer side of the inner shielding layer for transmitting a common power signal; and a plurality of pairs of differential signal wires disposed at the outer side of the inner shielding layer;

wherein each pair of differential signal wires is disposed between two adjacent second wires; and wherein each differential signal wire comprises a central conductor, an insulator enclosing the central conductor, a drain wire disposed at an outer side of the insulator, a shielding layer enclosing the drain wire and the insulator, and a tap enclosing the shielding layer.

2. The cable as recited in claim 1, wherein the drain wire has a diameter less than a diameter of the insulator.

3. The cable as recited in claim 1, wherein the drain wire contacts and electrically connects with the shielding layer.

4. The cable as recited in claim 1, wherein there are four pairs of differential signal wires and four second wires.

5. The cable as recited in claim 1, wherein the first wires comprise a pair of twist wires for transmitting USB 2.0 signal.

6. The cable as recited in claim 5, wherein the first wires comprise a detection signal wire, a pair of power grounding wires disposed at opposite sides of the detection signal wire, a power wire disposed at a side of the twist wires, and a pair of spare wires.

7. The cable as recited in claim 1, further comprising a tap layer enclosing the differential signal wires pairs and the second wires, an outer shielding layer enclosing the tap layer, and a jacket enclosing the outer shielding layer.

8. The cable as recited in claim 1, wherein each of the second wires has a diameter less than a diameter of each of the pair of differential signal wires.

9. A round cable comprising:

a plurality of first wires located at a center thereof and including at least three different type wires;

a plurality of second wires and a plurality of third wire pairs alternately along a periphery of the inner shielding layer in a surrounding manner; wherein each of the third wire pair includes two differential-pair signal wires while each of the second wires is a power wire, and each of the two differential-pair signal wires is larger than each of the second wires in a cross-sectional view; and said plurality of first wires are commonly enclosed within an inner shielding layer.

10. The round cable as claimed in claim 9, wherein each of said two differential-pair signal wires comprises a central conductor, an insulator enclosing the central conductor, a drain wire disposed at an outer side of the insulator, and a shielding layer enclosing the drain wire and the insulator.

11. The round cable as claimed in claim 10, wherein in each third wire pair, the two central conductors of said two differential-pair signal wires are spaced a first distance from each other while the two drain wires thereof are spaced a second distance greater than the first distance.

12. The round cable as claimed in claim 11, wherein the drain wire of each differential-pair signal wire is closely adjacent to the drain wire of another differential-pair signal wire of a neighboring third wire pair while the central conductor of said differential-pair signal wire is spaced from the central conductor of said another differential-pair signal wire with a corresponding second wire therebetween.

13. The round cable as claimed in claim 9, wherein the first wires include a power wire, a grounding wire, a detection wire, and two signal wires.

14. A cable comprising:

a plurality of first wires centrally disposed;

an inner shielding layer enclosing the first wires;

a plurality of second wires disposed at an outer side of the inner shielding layer for transmitting a common power signal; and a plurality of pairs of differential signal wires disposed at the outer side of the inner shielding layer;

wherein each pair of differential signal wires is disposed between two adjacent second wires;

wherein the first wires comprise a pair of twist wires for transmitting USB 2.0 signal; and wherein the first wires comprise a detection signal wire, a pair of power grounding wires disposed at opposite sides of the detection signal wire, a power wire disposed at a side of the twist wires, and a pair of spare wires.

15. The cable as recited in claim 14, wherein the drain wire has a diameter less than a diameter of the insulator.

16. The cable as recited in claim 14, wherein the drain wire contacts and electrically connects with the shielding layer.

17. The cable as recited in claim 14, wherein there are four pairs of differential signal wires and four second wires.

18. The cable as recited in claim 14, further comprising a tap layer enclosing the differential signal wires pairs and the second wires, an outer shielding layer enclosing the tap layer, and a jacket enclosing the outer shielding layer.

19. The cable as recited in claim 14, wherein each of the second wires has a diameter less than a diameter of each of the pair of differential signal wires.

20. A round cable comprising:

a plurality of first wires located at a center thereof and including at least a power wire, a grounding wire, a signal detection wire and a pair of signal wires; and a plurality of power wires and a plurality of differential-pair wire pairs alternately along a periphery of the inner shielding layer in a surrounding manner; wherein each pair of the differential-pair wire pairs includes two differential-pair signal wires, each of the two differential-pair signal wires is larger than each of the second wires in a cross-sectional view; wherein the first wires are commonly enclosed within an inner shielding layer; wherein each of said two differential-pair signal wires defines a tumbler configuration with a large bottom portion and a small top portion commonly surrounded within a shield layer in the cross-section view, and the bottom portion includes a central conductor enclosed within an inner insulator, and the top portion includes a drain wire contacting the shield layer.

* * * * *